United States Patent [19]

Jamrog

[11] Patent Number: 4,625,698

[45] Date of Patent: Dec. 2, 1986

[54] CLOSED LOOP AIR/FUEL RATIO CONTROLLER

[75] Inventor: Robert H. Jamrog, Rochester, Mich.

[73] Assignee: General Motors Corporation, Detroit, Mich.

[21] Appl. No.: 768,638

[22] Filed: Aug. 23, 1985

[51] Int. Cl.[4] ..... F02D 41/14

[52] U.S. Cl. ..... 123/489; 123/440

[58] Field of Search ..... 123/440, 480, 489

[56] References Cited

U.S. PATENT DOCUMENTS 3,926,154 12/1975 Williams ..... 123/489
4,029,061 6/1977 Asano ..... 123/489 X
4,203,394 5/1980 Aono et al. ..... 123/489 X
4,295,451 10/1981 Long ..... 123/438
4,306,523 12/1981 Takeda ..... 123/440
4,397,278 8/1983 Hughes ..... 123/489 X

*Primary Examiner*—Tony M. Argenbright
*Attorney, Agent, or Firm*—Howard N. Conkey

[57] ABSTRACT

A closed loop air/fuel ratio controller for an internal combustion engine is disclosed in which a proportional term is based on a fast filtered air/fuel ratio signal and an integral term is based on a slow filtered air/fuel ratio signal as well as the magnitude of the air/fuel ratio error outside of a deadband and the rich-lean conditions of the fast and slow air/fuel ratio signals.

4 Claims, 5 Drawing Figures

CLOSED LOOP AIR/FUEL RATIO CONTROLLER

BACKGROUND OF THE INVENTION

This invention relates to a closed loop air/fuel ratio controller for an internal combustion engine.

It is generally known that the amount of hydrocarbons, carbon monoxide and oxides of nitrogen present in the exhaust gases emitted from an internal combustion engine may be substantially reduced by controlling the air/fuel ratio of the mixture supplied to the engine and catalytically treating the exhaust gases emitted therefrom. For example, by controlling the air/fuel ratio of the mixture supplied to the engine near the stoichiometric value, a catalytic converter of the three-way type may be utilized to oxidize the carbon monoxide and hydrocarbons and reduce the oxides of nitrogen. The optimum air/fuel ratio of the mixture supplied to the engine for maximizing the conversion of the before-mentioned exhaust gas constituents is substantially the stoichiometric ratio. If the air/fuel ratio deviates from this ratio, either the reducing or oxidizing efficiency of the catalytic converter decreases resulting in an increase of the corresponding exhaust gas constituent.

In view of the foregoing, it is desirable to provide for the control of the air/fuel ratio of the mixture supplied to the engine substantially constant at the optimum ratio for maximizing the conversion efficiency of the three-way converter. To achieve this result, the control of the air/fuel ratio is provided by a closed loop controller which senses the condition of the exhaust gases and controls the ratio of air and fuel mixture supplied to the engine in response to the sensed condition so as to achieve substantially a stoichiometric ratio.

Two significant factors exist, however, which render it difficult to control the air/fuel ratio at a substantially constant value at the stoichiometric ratio. First, typical exhaust gas sensors used in closed loop air/fuel controllers are generally characterized in that they provide an output voltage that shifts abruptly between a high value representing a rich mixture relative to the stoichiometric value and a low level output representing a lean mixture relative to the stoichiometric value. Consequently, the sensor output is generally useful to indicate only the sense of deviation of the air/fuel ratio relative to the stoichiometric value. The second factor is the transport delay between the time at which a particular air and fuel mixture is supplied to the internal combustion engine and the time at which the resulting condition of the exhaust gases is sensed by the exhaust gas sensor. The tendency of this transport delay in the closed loop air/fuel ratio control system is to cause the air/fuel ratio controller to overshoot the desired stoichiometric air/fuel ratio which results in a decrease in either the oxidizing or reducing efficiency of the three-way catalytic converter.

It would be desirable to provide for a closed loop air/fuel ratio controller in which the variations in the controlled air/fuel ratio are minimized so as to maximize the conversion efficiency of the three-way catalytic converter.

SUMMARY OF THE INVENTION

It is the general object of this invention to provide an improved closed loop air/fuel ratio controller for an internal combustion engine.

It is another object of this invention to provide a closed loop air/fuel ratio controller having independent integral and proportional term corrections.

It is another object of this invention to provide a closed loop air/fuel ratio controller having a proportional correction term based on a fast filtered exhaust gas sensor signal and an integral term correction based on a slow filtered exhaust gas sensor signal.

It is another object of this invention to provide for an air/fuel ratio controller in accord with the foregoing objects in which integral and proportional corrections are made based upon a comparison of the sense of the fast and slow filtered outputs of the exhaust gas sensor.

BRIEF DESCRIPTION OF THE DRAWINGS

The invention may be best understood by reference to the following description of a preferred embodiment and the drawings in which.

DESCRIPTION OF THE PREFERRED EMBODIMENT

Figure 1:
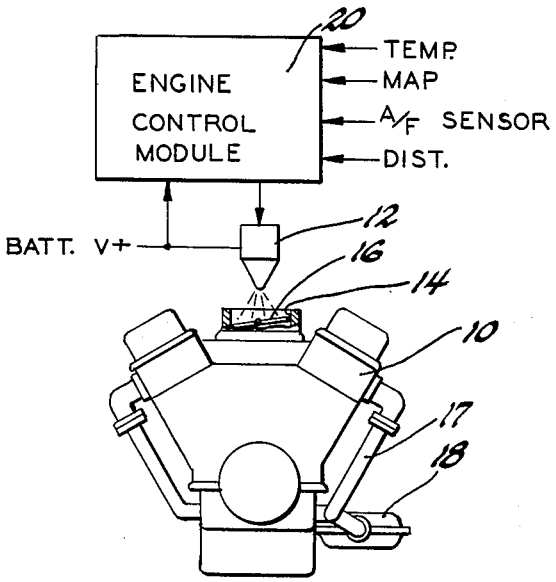
FIG. 1 illustrates an internal combustion engine and fuel control system incorporating the principles of this invention.
Figure 2:
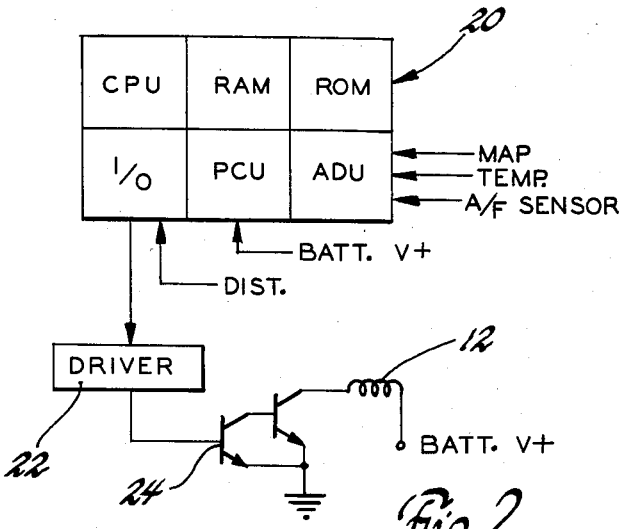
FIG. 2 is a diagram of the digital engine control module of FIG. 1 responsive to engine operating conditions for controlling the air/fuel ratio of the mixture supplied to the engine in accord with the principles of this invention.

Referring to FIGS. 1 and 2, there is illustrated a digital fuel injection system for metering fuel to the intake manifold of an internal combustion engine 10. While the invention is applicable to any fuel delivery system including a carburetor, for purposes of illustrating this invention, it is assumed that the engine 10 is supplied with fuel via a single fuel injector 12 mounted directly over the throttle bore 14 leading into the intake manifold of the engine 10. When the fuel injector 12 is opened, fuel is admitted at a substantially constant rate from a constant pressure fuel supply source (not illustrated) into the throttle bore 14 at a location above the throttle blade 16 where it is mixed with the air drawn into the intake manifold and thereafter into the combustion space of the engine 10. The combustion byproducts from the engine 10 are exhausted from its exhaust manifold to the atmosphere through an exhaust conduit 17 which includes a three-way catalytic converter 18 which simultaneously converts carbon monoxide, hydrocarbons and nitrogen oxides if the air-fuel mixture supplied thereto is maintained near the stoichiometric value. The injector 12 is energized by an engine control module (ECM) 20 for durations in accord with the values of various engine operating parameters to provide a desired ratio of the air-fuel mixture into the engine 10.

As specifically illustrated in FIG. 2, the ECM 20 in the present embodiment takes the form of a digital computer. The digital computer is standard in form and includes a central processing unit (CPU) which executes an operating program permanently stored in a read-only memory (ROM) which also stores tables and constants utilized in determining the fuel requirements of the engine. Contained within the CPU are conventional counters, registers, accumulators, flag flip flops, etc. along with a clock which provides a high frequency clock signal.

The ECM 20 also includes a random access memory (RAM) into which data may be temporarily stored and from which data may be read at various address locations determined in accord with the program stored in the ROM. A power control unit (PCU) receives battery voltage V+ and provides regulated power to the various operating circuits in the ECM 20. The ECM 20 also includes an input/output circuit (I/O) that in turn includes an output counter section. The output counter section is controlled by the CPU to provide timed injection pulses to a driver circuit 22 for energizing the injector 12 via a Darlington transistor 24.

The I/O also includes an input counter section which receives a pulse output from a conventional vehicle distributor which generates a pulse for each cylinder during each engine cycle. The distributor pulses are used for determining engine speed and for initiating the energization of the fuel injector 12. In this respect, engine speed may be determined by counting clock pulses from the internal clock between distributor pulses. Alternatively, electromagnetic pulse generators may be employed to generate engine speed signals.

The ECM 20 also includes an analog-to-digital unit (ADU) which provides for the measurement of analog signals. Analog signals representing conditions upon which the injection pulse widths are based are supplied to the ADU. In the present embodiment, those signals include a manifold absolute pressure signal (MAP) provided by a conventional pressure sensor, an engine coolant temperature signal (TEMP) provided by a conventional coolant temperature sensor and an air/fuel ratio signal A/F provided by a conventional air/fuel ratio sensor positioned in the exhaust manifold of the engine 10 to monitor the oxidizing/reducing conditions of the exhaust gases. The analog signals are each sampled and converted under control of the CPU. At the end of the conversion cycle, the ADU generates an interrupt after which the digital data is read on command from the CPU and stored in ROM designated RAM memory locations.

The various elements of the ECM 20 are interconnected by an address bus, a data bus and a control bus. The CPU accesses the various circuits and memory locations in the ROM and RAM via the address bus. Information is transmitted between the circuits via the data bus and the control bus includes conventional lines such as read/write lines, reset lines, clock lines, power supply lines, etc.

In general, the ECM 20 provides for closed loop control of the air/fuel ratio of the mixture supplied to the engine 10 in response to the output A/F of the air/fuel ratio sensor to provide a substantially constant stoichiometric air/fuel ratio resulting in a maximum operating efficiency of the three-way catalytic converter 18. This is accomplished by calculating the required pulse width based on the mass air flow through the engine 10 determined from the measured manifold absolute pressure and the volume of the cylinders, the known injector flow rates and the desired air/fuel ratio and then trimming the calculated value based on closed loop adjustment in response to the output signal A/F of the air/fuel ratio sensor.

Figure 3:
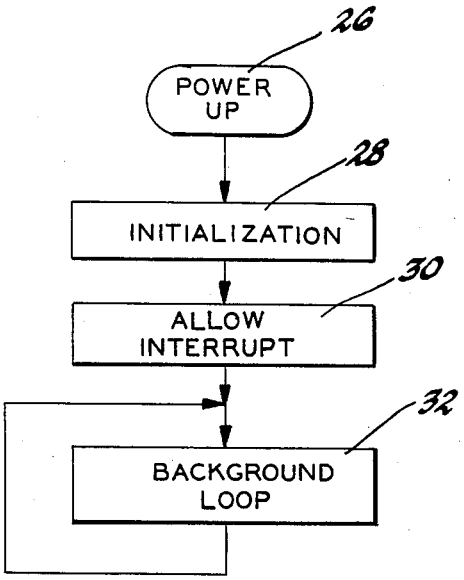
FIGS. 3 thru 5 are diagrams illustrating the operation of the digital engine controller in controlling the air/fuel ratio.
Figure 4:
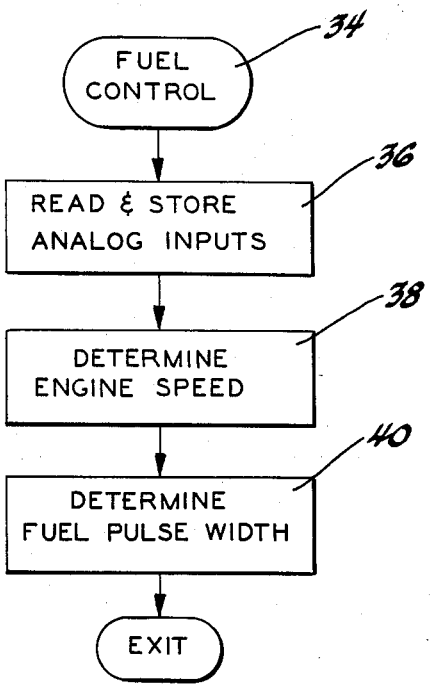
Figure 5:
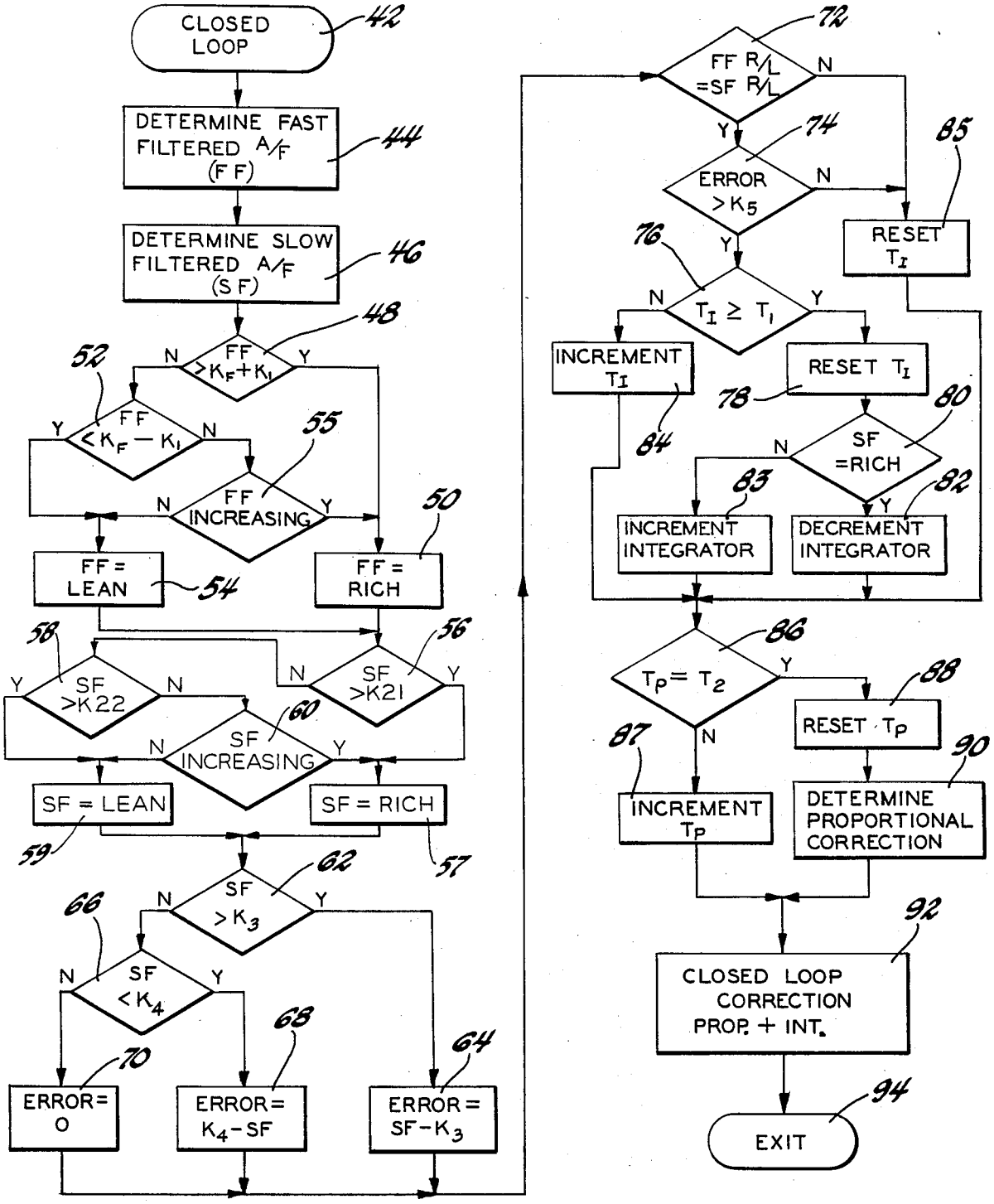

The operation of the engine control module 20 in determining the injection pulse width in accord with the principles of this invention is illustrated in FIGS. 3 through 5. Referring first to FIG. 3, when power is first applied to the system such as when the vehicle ignition switch is rotated to its "on" position the computer program is initiated at point 26 and then proceeds to a step 28 where the computer provides for system initialization. For example, at this step initial values stored in the ROM are entered into ROM designated locations in the RAM and counters, flags, and timers are initialized. After the initialization step 28, the program proceeds to a step 30 where the program allows interrupts to occur such as by resetting the interrupt mask bit in the CPU condition code register. After the step 30, the program shifts to a background loop 32 which is continuously repeated. This loop may include routines such as diagnostic and warning routines.

While the system may employ numerous program interrupts at various spaced intervals, it will be assumed for purposes of illustrating this invention that an interrupt is provided by the CPU at ten millisecond intervals during which a fuel control routine for determining the injection pulse width in accord with the principles of this invention is executed.

Referring to FIG. 4, the fuel control routine is illustrated. This routine is entered at point 34 and proceeds to a step 36 where the program executes the analog-to-digital conversion of the MAP and A/F signals and stores the resulting digital numbers at ROM designated locations in the RAM. Thereafter at step 38, the engine speed is sampled from the input counter section of the I/O and stored in a ROM designated RAM location.

At step 40, the program determines the fuel quantity required to produce the desired air/fuel ratio and then determines the duration of the injection pulse required to inject that fuel quantity. This fuel pulse duration is loaded into the output counter in the I/O controlling the fuel injector 12. When a distributor pulse is provided to the I/O, the injection pulse is issued to the driver 22 for the duration established at step 40.

The routine at step 40 first makes an open loop determination of the required fuel pulse duration based on the measured values of manifold absolute pressure and on a desired air/fuel ratio that may be dependent on engine operating parameters such as engine coolant temperature.

When the engine operating conditions are such that it is desired to operate at a stoichiometric air/fuel ratio to maximize the three-way conversion efficiency of the catalytic converter 18, the routine 40 provides for closed loop adjustment of the fuel pulse duration to be set into the I/O. This closed loop adjustment is made in response to the sensed oxidizing/reducing conditions in the exhaust gases discharged from the engine 10 as represented by the A/F signal.

As previously indicated, in order to minimize the discharge of undesirable exhaust gas constituents by maximizing the three-way conversion efficiency of the catalytic converter 18, it is desired to maintain this air/fuel ratio of the mixture drawn into the engine 10 substantially constant at the stoichiometric ratio, deviations from the stoichiometric ratio resulting in a decrease in the efficiency of the catalytic converter 18 in either its oxidizing or reducing functions.

The closed loop fuel control routine executed at step 40 for trimming the calculated fuel pulse duration in accord with the principles of this invention so as to maintain a substantially constant air/fuel ratio of the mixture supplied to the engine is illustrated in FIG. 5. Referring to this figure, the closed loop routine is entered at step 42 and proceeds to a step 44 where the output signal A/F of the air/fuel ratio sensor is filtered by utilization of a standard filter equation which as a fast time constant resulting in a fast filtered air/fuel ratio signal FF. This newly calculated value is stored along with the value calculated during the prior interrupt period.

From step 44, the program proceeds to a step 46 where a slow filtered air/fuel ratio signal SF is provided by filtering the fast filtered air/fuel ratio signal FF provided at step 44. In one embodiment, the time constant utilized at step 46 for filtering the fast filtered air/fuel ratio signal FF is made a function of the air flow through the engine and may be determined via a lookup table as a function of engine speed and manifold absolute pressure. This time constant is related to the transport lag through the engine 10, the transport lag being the duration between the time when a particular air-fuel mixture is provided to the engine 10 and the time at which the resulting condition is sensed by the air/fuel ratio sensor. Typically, the time constant selected results in a peak-to-peak amplitude in the variation of the slow filtered air/fuel ratio signal SF that is approximately $\frac{1}{4}$ to $\frac{1}{2}$ of the peak-to-peak amplitude variation in the fast filtered air/fuel ratio signal FF when the air/fuel ratio control conditions are stable and the air/fuel ratio is at the desired level and stable. When the slow filtered air/fuel ratio signal becomes greater than the stable steady state amplitude, modifications to the proportional and integral gains may be made by means of look-up tables.

From step 46, the program next proceeds to determine the rich-lean state of the air/fuel ratio of the mixture supplied to the engine as represented by the fast filtered air/fuel ratio signal FF determined at step 44. In this regard, when the fast filtered air/fuel ratio signal FF is within a window around a voltage representing the desired air/fuel ratio such as the stoichiometric ratio, the rich-lean status is determined by the direction in which the fast filtered air/fuel ratio signal is moving. In other words, within the window, a rich air/fuel ratio status is indicated if the direction of the fast filtered air/fuel ratio signal FF indicates the air/fuel ratio moving in a rich direction even though the magnitude of the signal is on the lean side of the value representing the desired ratio. Conversely, if the direction of the air/fuel ratio represented by the fast filtered air/fuel ratio signal FF is in the lean direction, a lean air/fuel ratio status is indicated even though the magnitude of the fast filtered air/fuel ratio signal FF is on the rich side of the value representing the desired ratio.

The determination of the rich-lean status of the fast filtered air/fuel ratio signal FF is begun at decision point 48 where the fast filtered air/fuel ratio signal FF is compared to the sum of a value $K_F$ representing a stoichiometric ratio and a constant $K_1$ defining one-half the width of the aforementioned window. If the value of the fast filtered air/fuel ratio signal FF is greater than this sum representing a rich air/fuel ratio status, the program proceeds to a step 50 at which a ROM designated memory location in the RAM is set to a state indicating a rich status of the fast filtered air/fuel ratio signal FF. If at decision point 48 it is determined that the value of the fast filtered air/fuel ratio signal FF is less than the upper boundary of the window, the program proceeds to a decision point 52 to determine whether or not the value of the fast filtered air/fuel ratio signal FF is less than the lower boundary of the window. This is accomplished by comparing the fast filtered air/fuel ratio signal FF with the difference between the value $K_F$ representing a stoichiometric ratio and the constant $K_1$. If the value is less than the lower boundary, the program proceeds to a step 54 where the ROM designated RAM memory location representing the rich-lean status of the fast filtered air/fuel ratio signal FF is set to indicate a lean status.

If at decision point 52 the fast filtered air/fuel ratio signal FF is greater than the lower boundary of the window, the fast filtered air/fuel ratio signal value is in the window defined by $K_1$. Within this window, the direction of movement of the signal FF determines the rich-lean status thereof. If this condition exists, the program proceeds from the decision point 52 to the decision point 55 where the direction of movement of the fast filtered air/fuel ratio signal FF is determined by comparing the new and old values of the fast filtered signal FF stored at step 44. If the signal is increasing indicating a movement in the rich direction, the program proceeds to step 50 wherein the rich-lean status of the fast filtered air/fuel ratio signal is set to rich. If, however, the fast filtered air/fuel ratio signal FF is decreasing, the program proceeds to the step 54 where the fast filtered air/fuel ratio status is set to lean.

Following step 50 or 54, the program next proceeds to determine the rich/lean status of the slow filtered air/fuel ratio signal SF determined at step 46. This status is used in the determination of the integral correction in the closed loop adjustment of the fuel provided to the engine 10.

As with the fast filtered air/fuel ratio signal, when the slow filtered air/fuel ratio signal SF is within a window defined by constants $K_{21}$ and $K_{22}$ around a voltage representing the desired air/fuel ratio, the rich-lean status is determined by the direction in which the slow filtered air/fuel ratio signal is moving. The determination of the rich-lean status of the slow filtered air/fuel ratio signal SF is begun at decision point 56 where the slow filtered air/fuel ratio signal SF is compared to a value $K_{21}$. If the value of the slow filtered air/fuel ratio signal SF is greater than $K_{21}$ representing a rich air/fuel ratio status, the program proceeds to a step 57 at which a ROM designated memory location in the RAM is set to a state indicating a rich status of the slow filtered air/fuel ratio signal SF. If at desision point 56 it is determined that the value of the slow filtered air/fuel ratio signal SF is less than $K_{21}$, the program proceeds to a decision point 58 to determine whether or not the value of the slow filtered air/fuel ratio signal SF is less than a lower value $K_{22}$. If the value is less than $K_{22}$, the program proceeds to a step 59 where the ROM designated RAM memory location representing the rich-lean status of the slow filtered air/fuel ratio signal SF is set to indicate a lean status.

If at decision point 58 the slow filtered air/fuel ratio signal SF is greater than $K_{22}$, the slow filtered air/fuel ratio signal value is in the window defined by $K_{21}$ and $K_{22}$. Within this window, the direction of movement of the signal SF determines the rich-lean status thereof. If this condition exists, the program proceeds from the decision point 58 to the decision point 60 where the direction of movement of the slow filtered air/fuel ratio signal SF is determined by comparing the new and old values stored at step 46. If the signal is increasing indicating a movement in the rich direction, the program proceeds to step 57 wherein the rich-lean status of the slow filtered air/fuel ratio signal is set to rich. If, however, the slow filtered air/fuel ratio signal SF is decreasing, the program proceeds to the step 59 where the slow filtered air/fuel ratio status is set to lean.

According to one aspect of this invention, a zero-error deadband is provided for the integral correction and the integral correction is provided only when the error is outside of this deadband by a predetermined value. The magnitude of the error taking into account the desired deadband is determined beginning at decision point 62 following either step 57 or 59. At decision point 62, the slow filtered air/fuel ratio signal is compared with a value $K_3$ representing the upper value of the zero-error deadband. If the slow filtered air/fuel ratio signal is greater than $K_3$, the program proceeds to a step 64 where the slow filtered air/fuel ratio error is set equal to the slow filtered air/fuel ratio signal SF minus the value $K_3$ representing the upper value of the zero deadband. If the slow filtered air/fuel ratio signal SF is less than $K_3$, the program proceeds to a decision point 66 where it is compared with a value $K_4$ representing the lower error of the zero-error deadband. If the slow filtered air/fuel ratio signal SF is less than $K_4$, the program proceeds to a step 68 where the slow filtered air/fuel ratio error is set to the difference between the value $K_4$ and the slow filtered air/fuel ratio signal value. If at step 66, it is determined that the slow filtered air/fuel ratio signal is greater than the constant $K_4$, the slow filtered air/fuel ratio signal is within the zero-error deadband, and the program proceeds to a step 70 where the slow filtered air/fuel ratio error is set to zero.

The values of $K_3$ and $K_4$ in decision point 62 and 66 are selected so that during steady state operation of the engine 10, the slow filtered air/fuel ratio signal determined at step 46 remains within the deadband established by $K_3$ and $K_4$ so that the error represented by the slow filtered air/fuel ratio signal is set to zero at step 70. The values of $K_3$ and $K_4$ may also be varied as a function of flow by means of look-up tables in the ROM. Air/fuel ratio sensors do not reduce and are therefore blind to oxygen in the nitrogen oxides present in the exhaust gases. If the slow filtered air/fuel ratio signal is the same, but nitrogen oxides increase, the increased oxygen causes reduced nitrogen oxide conversion efficiency in a three-way catalytic converter in the exhaust stream. By making $K_3$ and $K_4$ higher at higher flows when nitrogen oxides are usually higher, the nitrogen oxide conversion efficiency in the catalytic converter can be maintained.

In accord with another aspect of this invention, when the rich/lean status of the slow and fast filtered air/fuel ratio signals are opposite, no integral correction is provided to the fuel amount supplied to the engine 10. This condition is determined following either step 64, 68 or 70 at decision point 72 where the rich/lean status of the fast filtered air/fuel ratio signal is compared with the rich-lean status of the slow filtered air/fuel ratio signal, both of which were determined earlier in the closed loop routine. If the rich-lean status of each is the same, the program next proceeds to determine whether the other conditions exist for providing for an integral correction. The first such condition is whether or not the slow filtered air/fuel ratio signal error is greater than a calibration constant $K_5$. Alternatively, $K_5$ may be determined based on air flow through the engine represented by engine speed and manifold absolute pressure.

If the error is greater than $K_5$, an integral correction is desired and the program proceeds to determine whether a predetermined time period $T_1$ has lapsed since the last updating of the integral correction. This is done at step 76 where the time since the last correction $T_I$ is compared with a calibration constant $T_1$ which also may be made a function of engine air flow. If the time is equal to or greater than $T_1$, the program proceeds to a step 78 where the register in the RAM timing the interval $T_I$ is reset to zero. Thereafter, the program proceeds to the decision point 80 where the rich-lean status of the slow filtered air/fuel ratio signal determined at step 58 or 60 is sensed. If the status is rich, the program proceeds to a step 82 where an integrator value stored in a ROM designated RAM memory location is decremented. If the slow filtered air/fuel ratio signal status is lean, the program proceeds from the decision point 80 to a step 83 where the integrator value stored in the RAM is incremented. If the time interval since the last adjustment of the integrator at steps 82 or 83 is less than the time $T_1$, the program proceeds from the step 76 to a step 84 where the timing register timing the value $T_I$ is incremented and the program then bypasses the integrator adjustment of steps 78 thru 83.

If the rich-lean status of the fast and slow filtered air/fuel ratio signals FF and SF are opposite as determined at point 72 or if the slow filtered air/fuel ratio error is less than the value $K_5$ as determined at point 74, the program proceeds from the decision points 72 or 74 to a step 85 where the register timing the interval $T_I$ is reset to zero.

From the steps 82, 83, 84 or 85, the program executes steps to establish the proportional correction. The proportional correction is updated each time period $T_2$ which may be variable as a function of the error value established at step 64, 68 or 70 and as a function of engine air flow. The time $T_P$ since the last adjustment to the proportional correction term is compared to the value $T_2$ at decision point 86. If the time since the last update is less than $T_2$, the program proceeds to step 87 where a timing register in the RAM is incremented. If the time $T_2$ has expired as determined at decision point 86, the condition for updating the proportional correction exists and the program proceeds a first reset the RAM register timing the period $T_P$ at step 88 and then proceeds to step 90 to determine the proportional term of the closed loop correction.

The proportional term correction established at step 90 is a function of the magnitude of the error established at steps 64, 68 and 70 and has a positive value if the fast filtered air/fuel ratio signal FF status is lean as determined at step 54 and has a negative value if the fast filtered air/fuel ratio signal FF status is rich as determined at step 50. If desired, the magnitude of the proportional term correction may be reduced if the rich-lean status of the fast and slow filtered air/fuel ratio signals are opposite. The determined proportional correction is stored in a ROM designated RAM location.

From step 87 or 90, the program proceeds to a step 92 where the total closed loop correction to the calculated fuel pulse duration is determined by adding the stored proportional and integral terms. From step 92, the program exits the closed loop routine at step 94.

The foregoing description of a preferred embodiment for purposes of illustrating the invention is not to be considered as limiting or restricting the invention since many modifications may be made by the exercise of skill in the art without departing from the scope of the invention.

The embodiments of the invention in which an exclusive property or privilege is claimed are defined as follows:

1. An air-fuel mixture control system for an internal combustion engine having combustion space into which an air-fuel mixture is drawn to undergo combustion and having an exhaust passage into which combustion gases from the combustion space are discharged, the system comprising in combination:

a mixture supply means for supplying a mixture of air and fuel to the combustion space;

a sensor responsive to the combustion gases in the exhaust passage for generating an air/fuel ratio signal related to the value of the air/fuel ratio of the mixture supplied by the mixture supply means;

filter means responsive to the air/fuel ratio signal for generating a fast filtered air/fuel ratio signal and a slow filtered air/fuel ratio signal;

means responsive to the fast filtered air/fuel ratio signal for providing a proportional adjustment to the ratio of the air-fuel mixture supplied by the mixture supply means in a direction tending to produce a predetermined air/fuel ratio; and means responsive to the slow filtered air/fuel ratio signal for providing an integral adjustment to the ratio of the air-fuel mixture supplied by the mixture supply means in a direction tending to produce the predetermined air/fuel ratio, the combined proportional and integral adjustment providing for a stable ratio of the air-fuel mixture with minimum amplitude variation.

2. An air-fuel mixture control system for an internal combustion engine having combustion space into which an air-fuel mixture is drawn to undergo combustion and having an exhaust passage into which combustion gases from the combustion space are discharged, the system comprising in combination:

a mixture supply means for supplying a mixture of air and fuel to the combustion space;

a sensor responsive to the combustion gases in the exhaust passage for generating an air/fuel ratio signal related to the value of the air/fuel ratio of the mixture supplied by the mixture supply means;

filter means responsive to the air/fuel ratio signal for generating a fast filtered air/fuel ratio signal and a slow filtered air/fuel ratio signal;

means responsive to the fast filtered air/fuel ratio signal for providing a proportional adjustment to the ratio of the air-fuel mixture supplied by the mixture supply means in a direction tending to produce a predetermined air-fuel ratio;

means responsive to the slow filtered air/fuel ratio signal for generating an error signal having a value equal to the amount the slow filtered air/fuel ratio signal is outside of a predetermined range, the range establishing a zero error deadband; and means for providing an integral adjustment to the ratio of the air-fuel mixture supplied by the mixture supply means in a direction tending to produce the predetermined air/fuel ratio, the means providing an integral adjustment including means for varying the integral adjustment in the direction tending to produce the predetermined air/fuel ratio when the value of the error signal exceeds a predetermined error magnitude, the combined proportional and integral adjustment providing for a stable ratio of the air-fuel mixture with minimum amplitude variation.

3. An air-fuel mixture control system for an internal combustion engine having combustion space into which an air-fuel mixture is drawn to undergo combustion and having an exhaust passage into which combustion gases from the combustion space are discharged, the system comprising in combination:

a mixture supply means for supplying a mixture of air and fuel to the combustion space;

a sensor responsive to the combustion gases in the exhaust passage for generating an air/fuel ratio signal related to the value of the air/fuel ratio of the mixture supplied by the mixture supply means;

filter means responsive to the air/fuel ratio signal for generating a fast filtered air/fuel ratio signal and a slow filtered air/fuel ratio signal;

means responsive to the fast filtered air/fuel ratio signal for providing a proportional adjustment to the ratio of the air-fuel mixture supplied by the mixture supply means in a direction tending to produce a predetermined air/fuel ratio; and means responsive to the slow filtered air/fuel ratio signal for providing an integral adjustment to the ratio of the air-fuel mixture supplied by the mixture supply means in a direction tending to produce the predetermined air/fuel ratio only when the fast and slow filtered air/fuel ratio signals both represent an air/fuel ratio greater than the predetermined air/fuel ratio or when the fast and slow filtered air/fuel ratio signals both represent an air/fuel ratio less than the predetermined air/fuel ratio, the combined proportional and integral adjustment providing for a stable ratio of the air-fuel mixture with minimum amplitude variation.

4. An air-fuel mixture control system for an internal combustion engine having combustion space into which an air-fuel mixture is drawn to undergo combustion and having an exhaust passage into which combustion gases from the combustion space are discharged, the system comprising in combination:

a mixture supply means for supplying a mixture of air and fuel to the combustion space;

a sensor responsive to the combustion gases in the exhaust passage for generating an air/fuel ratio signal related to the value of the air/fuel ratio of the mixture supplied by the mixture supply means;

filter means responsive to the air/fuel ratio signal for generating a fast filtered air/fuel ratio signal and a slow filtered air/fuel ratio signal;

means responsive to the fast filtered air/fuel ratio signal for providing a proportional adjustment to the ratio of the air-fuel mixture supplied by the mixture supply means in a direction tending to produce a predetermined air/fuel ratio;

means responsive to the slow filtered air/fuel ratio signal for generating an error signal having a value equal to the amount the slow filtered air/fuel ratio signal is outside of a predetermined range, the range establishing a zero error deadband; and means for providing an integral adjustment to the ratio of the air-fuel mixture supplied by the mixture supply means in a direction tending to produce the predetermined air/fuel ratio (A) when the value of the error signal exceeds a predetermined error magnitude and (B) only when the fast and slow filtered air/fuel ratio signals both represent an air/fuel ratio greater than the predetermined air/fuel ratio or when the fast and slow filtered air/fuel ratio signals both represent an air/fuel ratio less than the predetermined air/fuel ratio, the combined proportional and integral adjustment providing for a stable ratio of the air-fuel mixture with minimum amplitude variation.

* * * * *